US006059425A

United States Patent [19]

Wang

[11] Patent Number: 6,059,425

[45] Date of Patent: May 9, 2000

[54] LAMP STRING WIRE CLIPPER

[76] Inventor: Jessica Wang, 16F-3, No. 70, Sec. 2, TunHa S. Road, Taipei City, Taiwan

[21] Appl. No.: 09/204,122

[22] Filed: Dec. 2, 1998

[51] Int. Cl.[7] ..... F21V 21/00

[52] U.S. Cl. ..... 362/249; 362/252; 362/391; 362/396; 362/806

[58] Field of Search ..... 362/249, 252, 362/374, 391, 396, 806

[56] References Cited

U.S. PATENT DOCUMENTS

| | | | |
|---|---|---|---|
| 5,709,462 | 1/1998 | Rumpel | 362/249 |
| 5,788,362 | 8/1998 | Chou | 362/249 |
| 5,893,628 | 4/1999 | Byers | 362/252 |

*Primary Examiner*—Sandra O'Shea
*Assistant Examiner*—John A. Ward

[57] ABSTRACT

A lamp string wire clipper for joining two sets of wires of a lamp string together comprises an upper case formed by a base and four projecting portions; a base portion formed by a base plate and four convex portions, the base plate having four small engaging holes near the edges, the positions of the engaging holes being correspondent to that of the hooks on the projecting portions. In assembling, a lamp structure including a lamp inserted in the lamp seat is firstly inserting into the through hole of the case cover to be clipped by the edge of the hole and stand therewithin. Then a pair of wires are arranged to pass through two opposite gags. Next, the case cover is disposed within the base portion, while the pair of wires passed through the lamp seat will pass through another two opposite gaps. Finally, the hooks is tightly fit into the holes so that the tips on each top portion of the hook will hook the edge, the upper case and the base portion are assembled.

3 Claims, 5 Drawing Sheets

LAMP STRING WIRE CLIPPER

FIELD OF THE INVENTION

The present invention relates generally to a lamp string, such as a Christmas lamp string, and in particular to a wire clipper for securing wires of the lamp string together at desired positions so as to form for example a net-like configuration of the lamp string for enhancing the decorative effectiveness.

BACKGROUND OF THE INVENTION

Accordingly, the object of the present invention is to provide a lamp string wire clipper which may secures two sets of wires of the lamp string together in such a way that lamp clipper and the lamp mounted therein run substantially normal to the plane on which the two sets of wires are located.

Another object of the present invention is to provide a lamp string wire clipper which allows two sets of wires of the lamp string to be secured together by any desired positions along the wires.

Lamp string, such as those used in for example Christmas, are well known and widely used in holidays and festivals for making joyful atmosphere. The lamp strings usually comprises a set of wires that usually has two wires for supplying electricity and a plurality of lamp holders physically and electrically connected to the wires with lamp received and held herein. The wires, usually flexible, may be bent and deformed nearly arbitrarily to form any desired shape and configuration. Some of the manufacturers of the lamp shape provide the lamp strings in the net-like configuration so that the user can easily fix the lamp string on the house or tree. To make the net-like configuration, it needs to secure are least two sets of wires together at predetermined positioned along the wires and conventionally, this is done by providing a wire fixing means on the lamp holder that is mounted on a first set of wires so that a second set of wires may be fixed to the first set of wires by being secured by the wires fixing means on the lamp holder.

The prior art lamp holder are usually of such a design that the wires are arranged to extend substantially parallel with the lamp holder and the lamp installed on the lamp holder. This makes the lamp and the light emitted therefrom partially shielded by the wires since they run substantially parallel with and thus substantially overlapped with each other.

Furthermore, such a design of securing the second set of wires to the lamp holder on the first set of the wires limits the locations where the two sets of wires may be jointed with each other.

Thus, it is desirable to provide a lamp string wires clipper which allows the wires to be secured together in such a way that the lamp holder and the lamp run substantially normal to the plane of the net like configuration of the lamp string and also allows the wires to the joined together at any desired positions along the wires.

SUMMARY OF THE INVENTION

Accordingly, the object of the present invention is to provide a lamp string wire clipper which may secure two sets of wires of the lamp string together in such a way that lamp clipper and the lamp mounted therein run substantially normal to the plane on which the two sets of wires are located.

Another object of the present invention is to provide a lamp string wire clipper which allows two sets of wires of the lamp string to be secured together by any desired positions along the wires.

Therefore, the present invention provides a lamp string wire clipper for joining two sets of wires of a lamp string together, comprising an upper case formed by an edge portion and four projecting portions, the upper case having a through hole in the center thereof. Each of the projecting portions have a respective hook extended from the top thereof. A base portion is formed by a base plate and four convex portions. The base plate have four small engaging holes near the edges, the positions of the engaging holes is correspondent to that of the hooks on the projecting portions. In assembling, a lamp structure including a lamp inserted in the lamp seat is firstly inserted into the through hole of the case cover to be clipped by the edge of the hole and stand therewithin, then a pair of wires are arranged to pass through two opposite gags, next, the case cover is arranged within the base portion, while the pair of wires passed through the lamp seat will pass through another two opposite gaps. Finally, the hooks is tightly fitted into the holes so that the tips on each top portion of the hook will hook the edge, accordingly, the upper case and the base portion are assembled.

The various objects and advantages of the present invention will be more readily understood from the following detailed description when read in conjunction with the appended drawing.

DETAILED DESCRIPTION OF THE PREFERRED EMBODIMENTS

Figure 1:
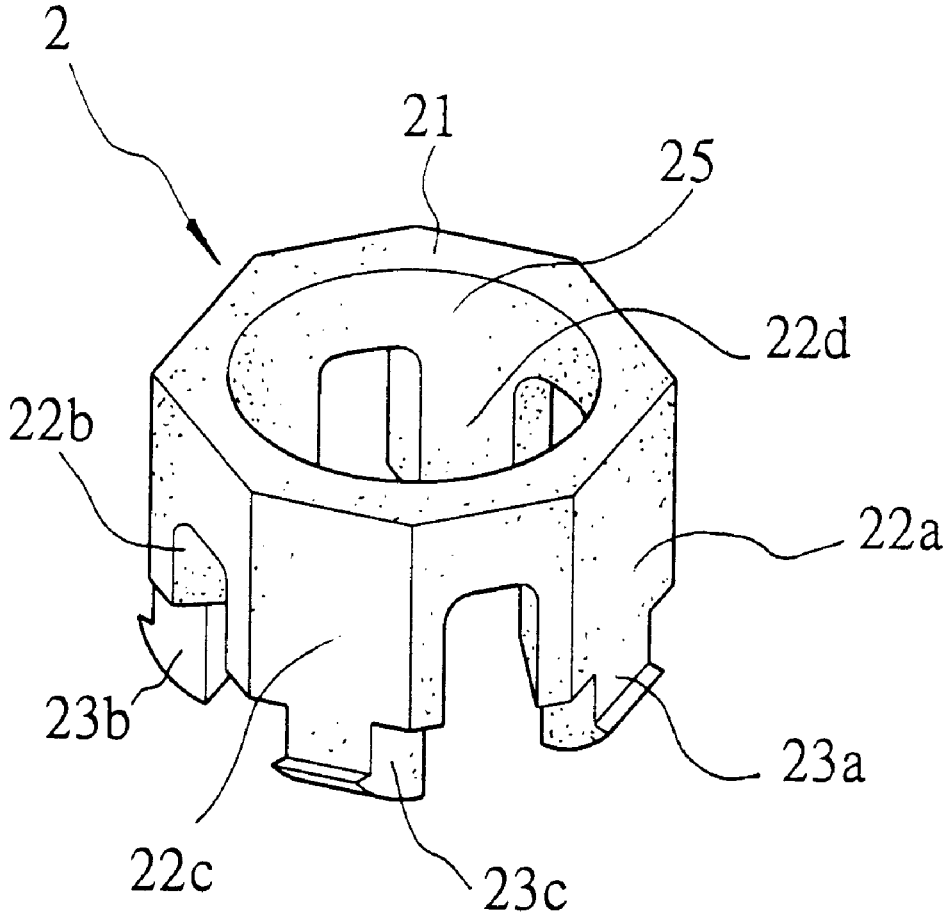
FIG. 1 is a perspective view showing the upper case of the lamp string wire clipper according to the present invention.
Figure 2:
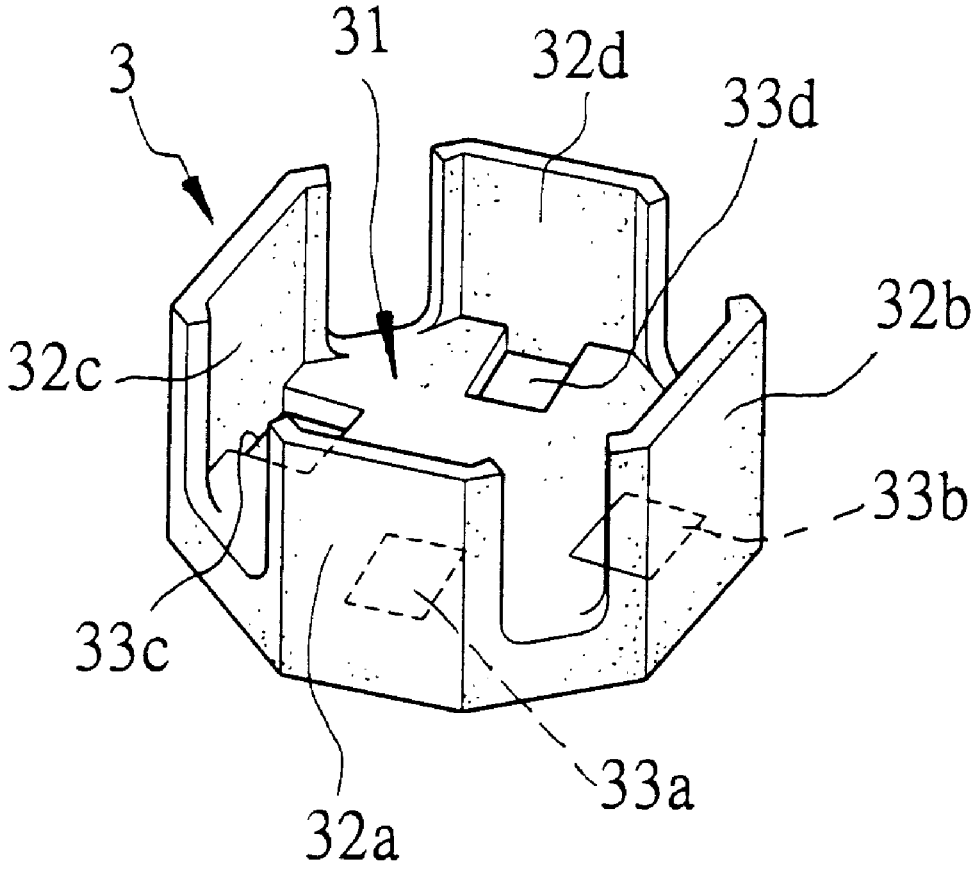
FIG. 2 is a perspective view showing the base portion of the lamp string wire clipper according to the present invention.

Referring now to FIGS. 1 and 2, the lamp string wire clipper of the present invention is shown. The wire clipper comprises an upper case 2 and a base portion 3. It is shown that the upper case 2 and the base portion 3 have generally a octagonal shape, but they does not need to be so, for example, it may has other shapes.

It is shown that the upper case 2 is formed by an edge portion 21 and four projecting portions 22*a*, 22*b*, 22*c* and 22*d*. The edge portion 21 has a through hole 25 in the center thereof. The size of through hole 25 is slightly smaller than that of a lamp seat for inserting thereto. While each of the projecting portions 22*a*, 22*b*, 22*c* and 22*d* has a respective hook 23*a*, 23*b*, 23*c* and 23*d*. Another, the base portion 3 is formed by a base plate 31 and four convex portions 32*a*, 32*b*, 32*c*, and 32*d*. The base plate 31 has four small via holes 33*a*, 33*b*, 33*c* and 33 *d* near the edges. The positions of the via holes 33*a*, 33*b*, 33*c* and 33*d* are correspondent to that of the hooks 22*a*, 22*b*, 22*c* and 22*d* on the upper case 2, while the size thereof is slightly larger than the size of the hooks 23*a*, 23*b*, 23*c*, and 23*d* so that a hook can be inserted into the hole tightly. The gaps between two convex portions are correspondent to that of two projecting portions.

Figure 3:
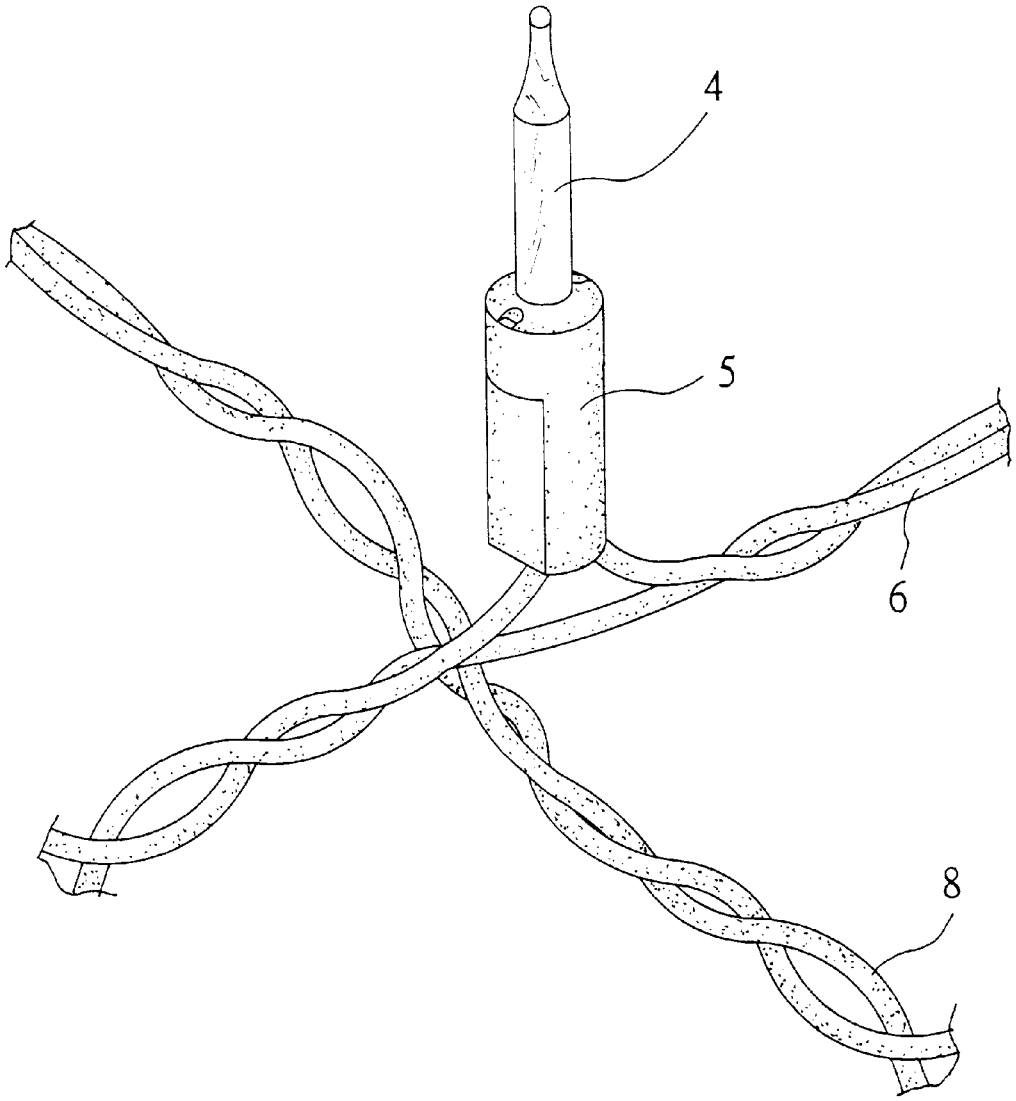
FIG. 3 is a perspective view showing a decorating lamp inserted within a lamp seat and a pair of electric wires.
Figure 4:
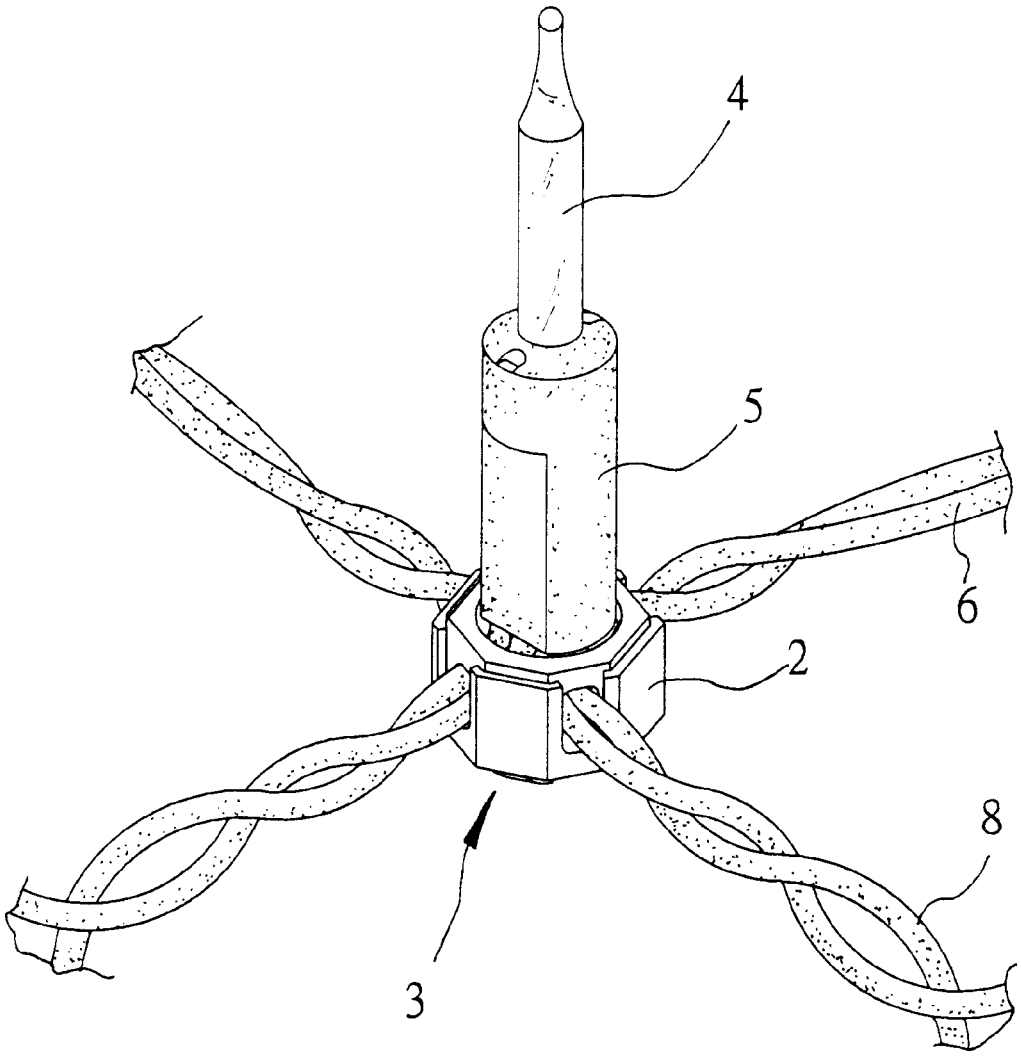
FIG. 4 is a perspective view showing that a lamp inserted within a lamp seat is assembled on the wire clipper of the present invention.

FIG. 3 is a perspective view showing a decorating lamp inserted within a lamp seat and a pair of twisted electric wires. A decorating lamp 4 is inserted into a lamp seat 5. A pair of electric wires 6 are formed by two wires with one of the wires passes through the lamp for supplying power into the lamp. Another pair of wires 8 is also shown in FIG. 3. FIG. 4 is a perspective view showing that an Christmas lamp inserted within a lamp seat is assembled on the wire clipper of the present invention. In assembling, the lamp structure including the decorating lamp 4 and the lamp seat 5 is firstly inserting into the through hole 25 to be clipped by the edge of the hole 25 and stand therewithin. Then the pair of wires 8 is arranged to pass through two opposite gags. Next, the upper case is disposed within the base portion 3 with the pair of wires passing through the lamp seat 5 passing through another two opposite gaps. Finally, the hooks 23*a*, 23*b*, 23*c* and 23*d* can be tightly fit into the via holes 33*a*, 33*b*, 33*c* and 33*d* so that the tips on each top portion of the hook will hook the edge. Thus, the upper case 2 and the base portion 3 are assembled as shown in FIG. 4. Therefore, the lamp clipper and the lamp mounted therein run substantially normal to the plane on which the two sets of wires are located.

In the present invention, the upper case 2 and the base portion 3 are made of elastic deformable materials, perferably nonconductive such as plastic, so that the gaps on the upper case 2 and the holes 33*a*, 33*b*, 33*c* and 33*d* and 25 are expandable by elastically deflecting. This allows that the lamp seat 5 can be inserted into the upper case 2, and the hooks 23*a*, 23*b*, 23*c* and 23*d* can be inserted into the holes 33*a*, 33*b*, 33*c* and 33*d* . Thus, once the elastic deflection of the upper case is removed, the gap and holes will restore back to their original size.

Figure 5:
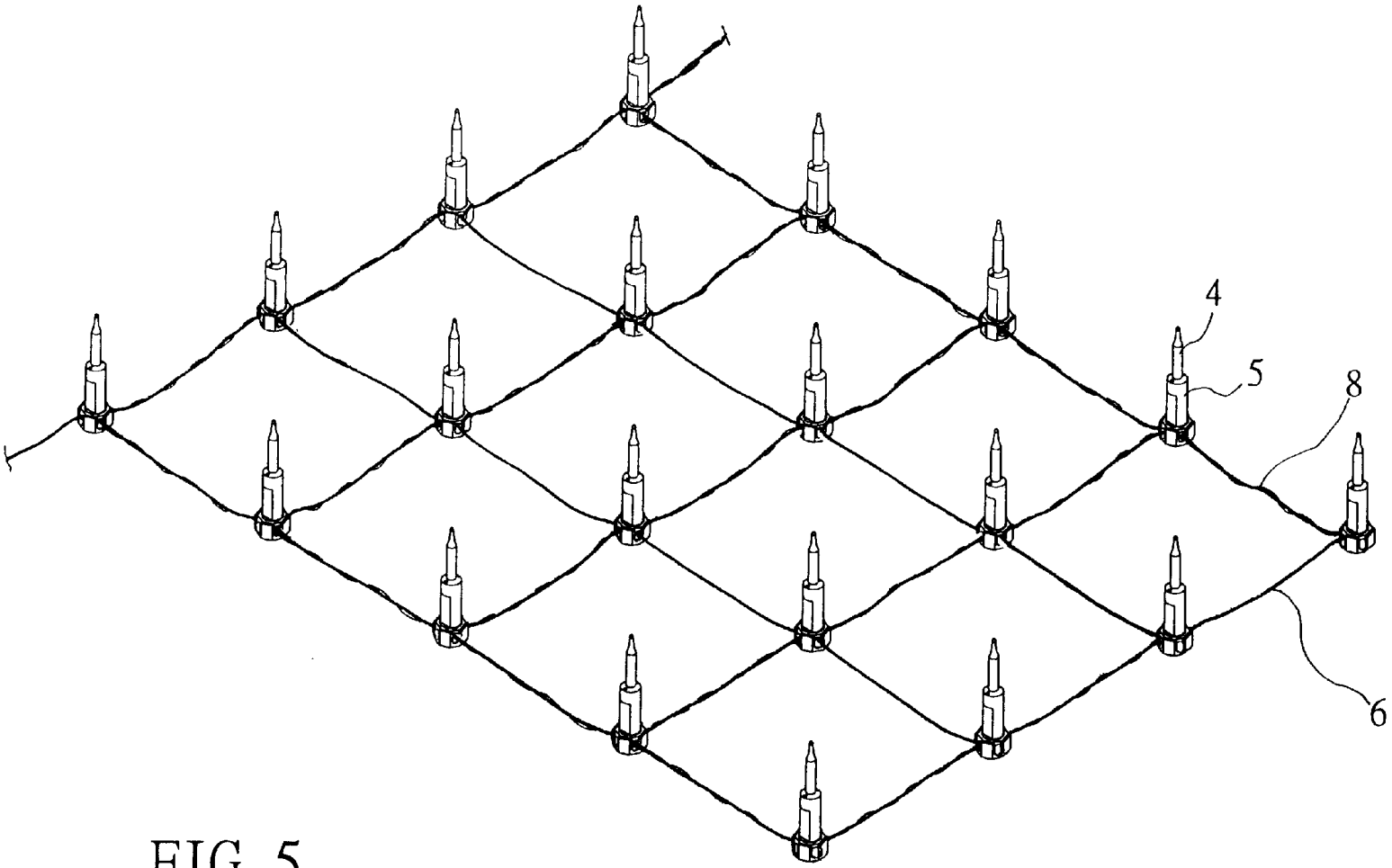
FIG. 5 shows an application of using the wire clipper of the present invention to join wires of a lamp string together to form a net-like configuration.

FIG. 5 shows an application of using the wire clipper 1 of the present invention to join wires 6 and 8 of a lamp string 30 together to form a net-like configuration.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A lamp string wire clipper for joining two sets of wires of a lamp string together, comprising:

an upper case formed by an edge portion and four projecting portions, the upper case having a through hole in the center thereof, the size of the through hole being slightly smaller than that of the lamp seat for inserting thereto, each of the projecting portions having a respective hook extended from the top thereof, a gap being formed between two adjacent projection portions, totally, there being four gaps;

a base portion formed by a base plate and four convex portions, the base plate having four small via holes near the edges, the positions of the via holes being correspondent to that of the hooks on the projecting portions, while the size thereof is slightly larger than the size of the hooks so that a hook can be inserted into the hole tightly, the gaps between two convex portions being respective to that of two projecting portions.

2. The lamp string wire clipper according to claim 1, wherein during assembling, a lamp structure including a lamp inserted in the lamp seat is firstly inserting into the through hole of the case cover to be clipped by the edge of the hole and stand therewithin, then a pair of wires are arranged to pass through two opposite gags, next, the case cover is arranged within the base portion, while the pair of wires passed through the lamp seat will pass through another two opposite gaps, finally, the hooks is tightly fit into the holes so that the tips on each top portion of the hook will hook the edge, therefore, the upper case and the base portion are assembled.

3.The lamp string wire clipper according to claim 1, wherein the upper case and the base portion are made of elastic deformable and nonconductive materials, so that the gaps on the upper case and the via holes of the base portion are expandable by elastically deflecting.

* * * * *